US010975737B2

(12) United States Patent
Suzuki

(10) Patent No.: US 10,975,737 B2
(45) Date of Patent: Apr. 13, 2021

(54) VALVE TIMING ADJUSTMENT DEVICE

(71) Applicant: DENSO CORPORATION, Kariya (JP)

(72) Inventor: Genki Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 4 days.

(21) Appl. No.: 16/865,805

(22) Filed: May 4, 2020

(65) Prior Publication Data

US 2020/0263574 A1 Aug. 20, 2020

Related U.S. Application Data

(63) Continuation of application No. PCT/JP2018/040815, filed on Nov. 2, 2018.

(30) Foreign Application Priority Data

Nov. 6, 2017 (JP) ..... JP2017-214052

(51) Int. Cl.
*F01L 1/34* (2006.01)
*F01L 1/352* (2006.01)
*F01L 1/02* (2006.01)

(52) U.S. Cl.
CPC ..... *F01L 1/352* (2013.01); *F01L 1/022* (2013.01); *F01L 2820/032* (2013.01)

(58) Field of Classification Search
CPC ... F01L 1/352; F01L 1/022; F01L 1/02; F01L 2820/032
USPC ..... 123/90.15–90.17
See application file for complete search history.

(56) References Cited

U.S. PATENT DOCUMENTS

| | | | | |
|---|---|---|---|---|
| 9,422,836 | B2 * | 8/2016 | Takahashi | F01L 1/352 |
| 2007/0295294 | A1 | 12/2007 | Morii et al. | |
| 2009/0199797 | A1 | 8/2009 | Schafer et al. | |
| 2009/0199801 | A1 * | 8/2009 | Imai | F01L 1/022 123/90.17 |

FOREIGN PATENT DOCUMENTS

| | | | |
|---|---|---|---|
| JP | 2007-309430 | | 11/2007 |
| JP | 2007309430 | A * | 11/2007 |
| JP | 2011-111971 | | 6/2011 |
| JP | 2014-51899 | | 3/2014 |
| JP | 2014051899 | A * | 3/2014 |

* cited by examiner

*Primary Examiner* — Zelalem Eshete
(74) *Attorney, Agent, or Firm* — Nixon & Vanderhye P.C.

(57) ABSTRACT

A cam plate is coupled to a driven-side shaft and is rotatable relative to a housing. A gear is placed on a side of the cam plate, which is opposite to the driven-side shaft. The housing has a contact surface that is configured to contact a wall surface of the cam plate, which is located on one side in an axial direction of the housing. Among two external toothed portions, one external toothed portion is located on an opposite side of the contact surface, which is opposite to the gear in the axial direction. The cam plate has a bearing portion that is located on a side of the contact surface, which is opposite to the gear, and the bearing portion has an outer peripheral surface configured to receive a radial load applied from an inner peripheral surface of the housing in a radially inward direction.

12 Claims, 9 Drawing Sheets

VALVE TIMING ADJUSTMENT DEVICE

CROSS REFERENCE TO RELATED APPLICATIONS

This application is a continuation application of International Patent Application No. PCT/JP2018/040815 filed on Nov. 2, 2018, which designated the U.S. and claims the benefit of priority from Japanese Patent Application No. 2017-214052 filed on Nov. 6, 2017. The entire disclosures of all of the above applications are incorporated herein by reference.

TECHNICAL FIELD

The present disclosure relates to a valve timing adjustment device.

BACKGROUND

Previously, there is known a valve timing adjustment device configured to adjust a valve timing of a valve of an internal combustion engine by making relative rotation between a housing, which is rotated synchronously with a driving-side shaft of the internal combustion engine, and a cam plate, which is coupled to a driven-side shaft.

SUMMARY

This section provides a general summary of the disclosure, and is not a comprehensive disclosure of its full scope or all of its features.

According to the present disclosure, there is provided a valve timing adjustment device configured to adjust a valve timing of a valve of an internal combustion engine. The valve timing adjustment device includes: a housing that is configured to rotate synchronously with one of a driving-side shaft and a driven-side shaft of the internal combustion engine; at least one external toothed portion that is shaped in a ring form and is formed integrally with the housing in one piece while the at least one external toothed portion is configured to engage with an endless transmission member that is wound around the driving-side shaft or another rotatable member that is configured to rotate; and a cam plate that is coupled with another one of the driving-side shaft and the driven-side shaft and is configured to rotate relative to the housing. The cam plate has a bearing portion that has an outer peripheral surface configured to receive a radial load applied from an inner peripheral surface of the housing in a radially inward direction.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
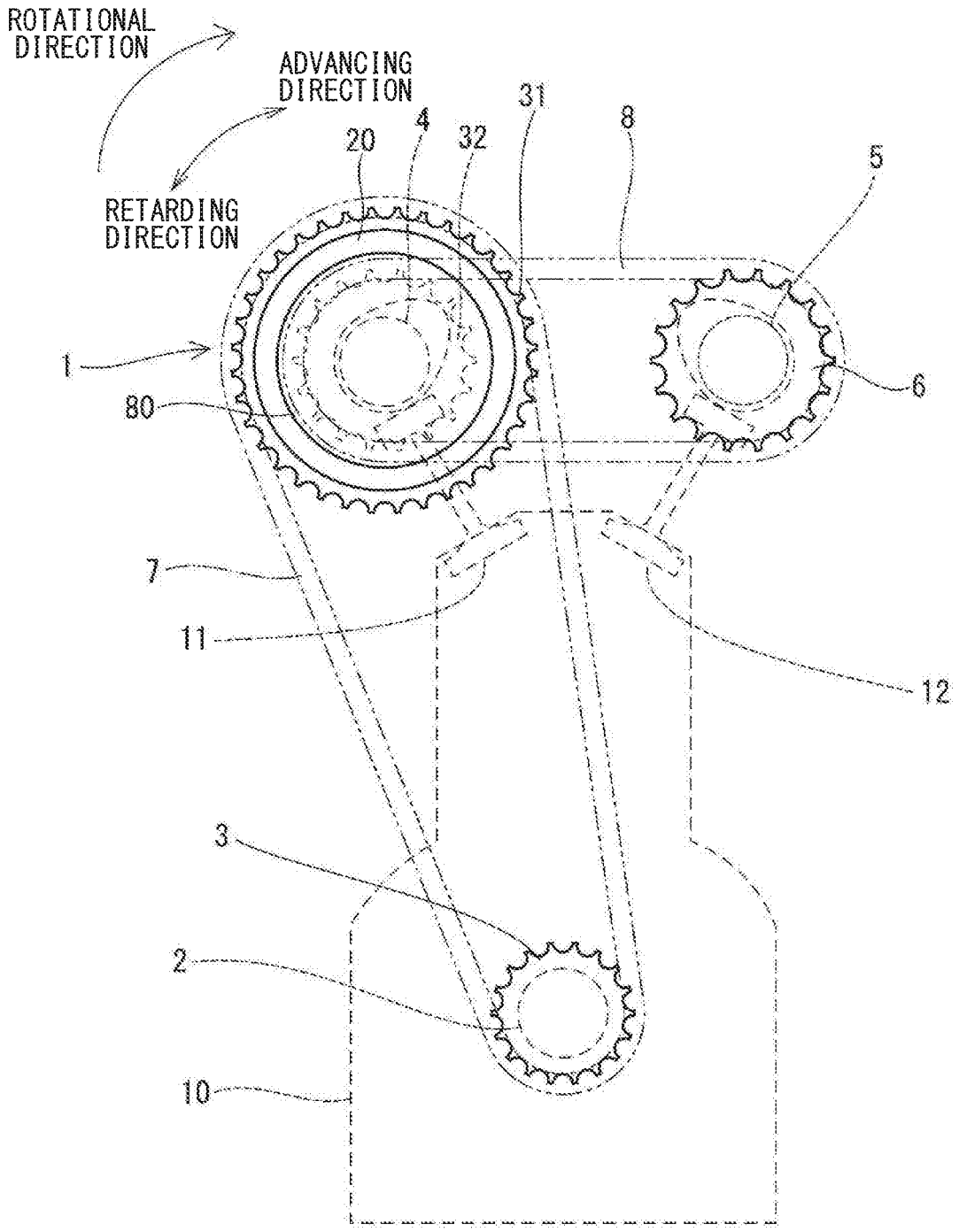
FIG. 1 is a schematic diagram showing an installed state of a valve timing adjustment device according to a first embodiment.

Previously, there is known a valve timing adjustment device configured to adjust a valve timing of a valve of an internal combustion engine by making relative rotation between a housing, which is rotated synchronously with a driving-side shaft of the internal combustion engine, and a cam plate, which is coupled to a driven-side shaft. For example, one such a valve timing adjustment device has been previously proposed. In this valve timing adjustment device, a housing is divided into two housings in an axial direction, and one of these two housings, which is located on a side where the driven-side shaft is placed, is provided with two external toothed portions, each of which is shaped in a ring form and is configured to engaged with a corresponding endless transmission member wound around a driving-side shaft or the like. Furthermore, this valve timing adjustment device includes a gear that is located on a side of the cam plate, which is opposite to the driven-side shaft, to mesh with the housing and the cam plate while the gear is rotated by an electric motor to implement relative rotation between the housing and the cam plate.

In the valve timing adjustment device described above, the housing has a contact surface that is configured to contact a wall surface of the cam plate, which is located on the driven-side shaft side. Furthermore, one of the two external toothed portions is formed on a side of the contact surface where the driven-side shaft is placed. Furthermore, in a state where the cam plate is coupled to the driven-side shaft, the cam plate and an end part of the driven-side shaft are located at an inside of the housing. At the time of operating the internal combustion engine, a radial load is applied to the housing in the radially inner direction from the endless transmission member through the external toothed portion, so that an outer peripheral surface of the cam plate and an outer peripheral surface of the driven-side shaft receive the radial load from an inner peripheral surface of the housing in the radially inner direction. Here, in a case where a gap between the outer peripheral surface of the cam plate and the inner peripheral surface of the housing is larger than a gap between the outer peripheral surface of the driven-side shaft and the inner peripheral surface of the housing, a bending stress is applied to the housing, and thereby the contact surface is urged against the wall surface of the cam plate located on the side where the driven-side shaft is placed. Therefore, the cam plate may possibly be deformed. When the cam plate is deformed, uneven contact between the cam plate and the gear occurs to possibly cause wearing of gear-tooth surfaces of the meshing portions, at which the cam plate and the gear are meshed with each other. Furthermore, when the contact surface is urged against the wall surface of the cam plate located on the side where the driven-side shaft is placed, an excess stress is generated at the contact surface and the wall surface of the cam plate to possibly cause wearing of the contact surface of the housing and the wall surface of the cam plate.

According to one aspect of the present disclosure, a valve timing adjustment device, which is configured to adjust a valve timing of a valve of an internal combustion engine, includes a housing, an external toothed portion, a cam plate and a gear. The housing is configured to rotate synchronously with one of a driving-side shaft and a driven-side shaft of the internal combustion engine. The external toothed portion is shaped in a ring form and is formed integrally with the housing in one piece. The external toothed portion is configured to engage with an endless transmission member that is wound around the driving-side shaft or another rotatable member that is configured to rotate. The number of the external toothed portion is at least one.

The cam plate is coupled with another one of the driving-side shaft and the driven-side shaft and is configured to rotate relative to the housing. The gear is located on a side of the cam plate, which is opposite to the another one of the driving-side shaft and the driven-side shaft. The gear is configured to be meshed with the housing and the cam plate and is configured to be rotated by an electric motor to implement relative rotation between the housing and the cam plate. The housing has a contact surface that is formed at an inner wall of the housing and is configured to contact a wall surface of the cam plate, which is located on one side in an axial direction of the housing.

The at least one external toothed portion is located on a side of the contact surface, which is opposite to the gear in the axial direction of the housing. The cam plate has a bearing portion that is located on the side of the contact surface, which is opposite to the gear. The bearing portion has an outer peripheral surface configured to receive a radial load applied from an inner peripheral surface of the housing in a radially inward direction. Therefore, when the radial load is applied to the housing in the radially inner direction from the endless transmission member through the external toothed portion, the radial load can be received by the bearing portion of the cam plate. In this way, it is possible to limit urging of the contact surface against the wall surface of the cam plate in response to application of the bending stress against the housing. As a result, the deformation of the cam plate can be limited, and the uneven contact between the cam plate and the gear can be limited. Therefore, the wearing of the gear-tooth surfaces of the meshing portions, at which the cam plate and the gear are meshed with each other, can be limited.

Furthermore, in the present embodiment, it is possible to limit the urging of the contact surface against the wall surface of the cam plate, and thereby it is possible to limit the generation of the excess stress at the contact surface and the wall surface. Therefore it is possible to limit the wearing of the contact surface of the housing and the wall surface of the cam plate.

Hereinafter, a valve timing adjustment device of various embodiments will be described with reference to the drawings. In the following embodiments, the substantially identical portions will be indicated by the same reference signs and will not be described redundantly. Furthermore, in the following embodiments, the substantially identical portions have the same or similar effects and advantages.

First Embodiment

A valve timing adjustment device and a drive force transmission system of a vehicle having the valve timing adjustment device according to a first embodiment will be described with reference to FIGS. 1 and 2.

In the drive force transmission system, in which the valve timing adjustment device 1 of the present embodiment is installed, as shown in FIG. 1, a chain (serving as an endless transmission member) 7 is wound around: a sprocket 3, which is coaxially fixed to a crankshaft (serving as a driving-side shaft) 2 of an internal combustion engine (hereinafter referred to as an engine) 10; and an external toothed portion 31, which is coaxial with a camshaft (serving as a driven-side shaft) 4. A drive force is transmitted from the crankshaft 2 to the camshaft 4 through the chain 7 and the external toothed portion 31. Furthermore, a chain (serving as an endless transmission member) 8 is wound around an external toothed portion 32, which is coaxial with the external toothed portion 31; and a sprocket 6, which is coaxially fixed to a camshaft (serving as a driven-side shaft) 5. The drive force is transmitted from the crankshaft 2 to the camshaft 5 through the chain 7, the external toothed portion 31, the external toothed portion 32 and the chain 8.

The external toothed portion 31 and a cam plate 40 described later respectively form a corresponding portion of the valve timing adjustment device 1. The camshaft 4 is rotated to open and close intake valves (serving as valves) 11, and the camshaft 5 is rotated to open and close exhaust valves (serving as valves) 12. The valve timing adjustment device 1 of the present embodiment is an electric valve timing adjustment device that uses an electric motor 80 (described later), which serves as a drive source. In this valve timing adjustment device 1, the external toothed portion 31 is connected to the chain 7, and the cam plate 40 is coupled to the camshaft 4 to adjust an opening/closing timing of the respective intake valves 11.

Figure 2:
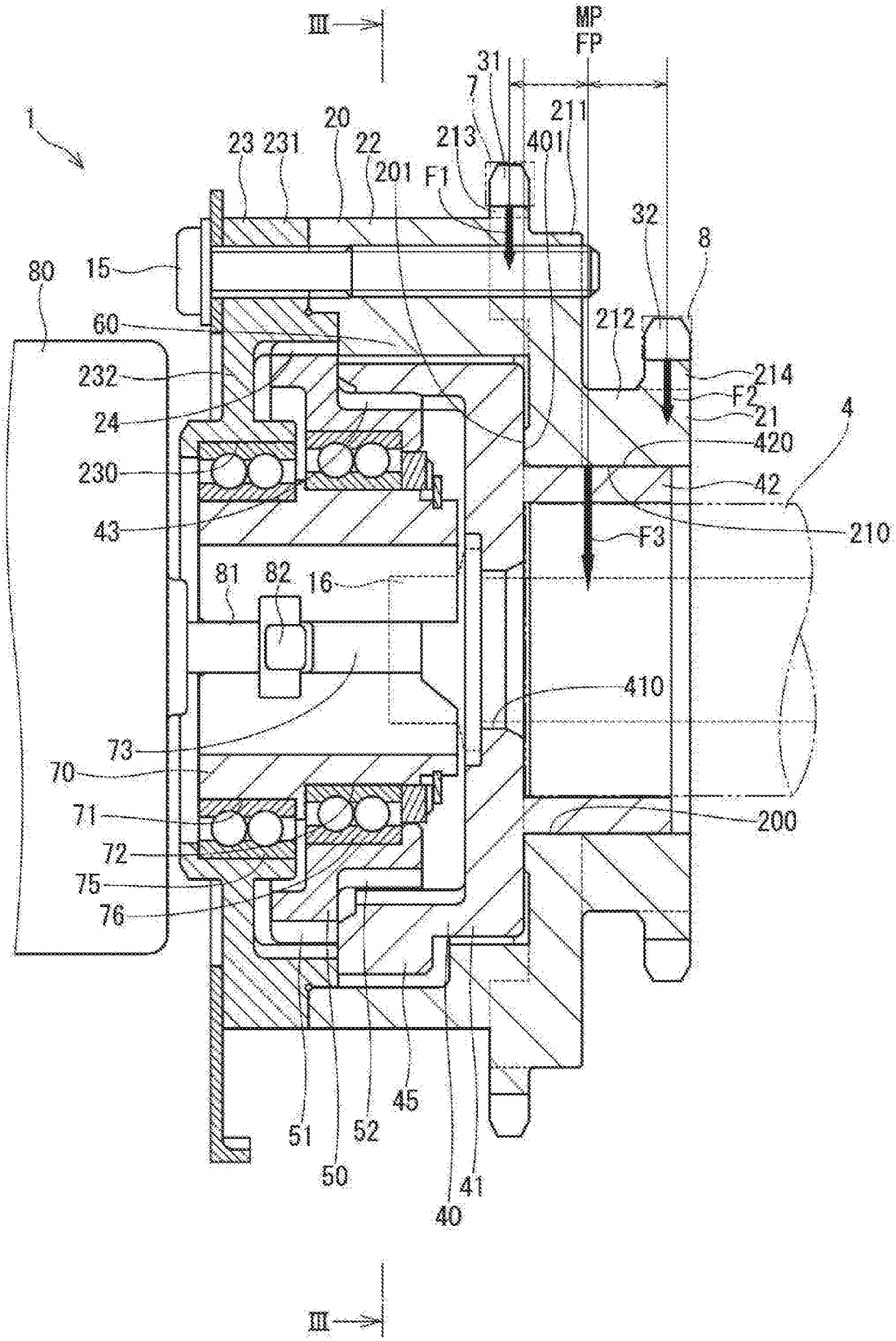
FIG. 2 is a cross-sectional view showing the valve timing adjustment device of the first embodiment.

As shown in FIG. 2, the valve timing adjustment device 1 includes a housing 20, the external toothed portion 31, the external toothed portion 32, the cam plate 40, a gear 50, a plurality of stoppers 60 and an input member 70.

The housing 20 includes an external toothed housing 21, a stopper housing 22 and a cover housing 23. The external toothed housing 21, the stopper housing 22 and the cover housing 23 are respectively made of metal. In the present embodiment, the external toothed housing 21 and the stopper housing 22 are formed integrally in one piece. The cover housing 23 is formed separately from the external toothed housing 21 and the stopper housing 22.

The external toothed housing 21 includes a housing plate portion 211, a housing tubular portion 212, a housing ring portion 213 and a housing ring portion 214. The housing plate portion 211 is shaped generally in a circular disk form. A housing hole 200 is formed at a center of the housing plate portion 211 such that the housing hole 200 extends through the housing plate portion 211 in a plate thickness direction of the housing plate portion 211. An inner peripheral surface of the housing hole 200 is shaped generally in a form of a cylindrical surface.

The housing tubular portion 212 is formed integrally with the housing plate portion 211 in one piece such that the housing tubular portion 212 extends in a tubular form from an outer periphery of the housing hole 200 at a surface of the housing plate portion 211 located on one side. An inner peripheral surface of the housing tubular portion 212 is shaped generally in a form of a cylindrical surface. An inner diameter of the housing hole 200 and an inner diameter of the housing tubular portion 212 are equal to each other. In this way, an inner peripheral surface 210, which is shaped generally in a form of a cylindrical surface, is formed at an inside of the housing hole 200 and of the housing tubular portion 212.

The housing ring portion 213 is shaped in a ring form and is formed integrally with the housing plate portion 211 in one piece such that the housing ring portion 213 radially outwardly extends from an outer peripheral surface of an end part of the housing plate portion 211, which is opposite to the housing tubular portion 212. The housing ring portion 214 is shaped in a ring form and is formed integrally with the housing tubular portion 212 in one piece such that the housing ring portion 214 radially outwardly extends from an outer peripheral surface of an end part of the housing tubular portion 212, which is opposite to the housing plate portion 211.

The stopper housing 22 is formed integrally with the housing plate portion 211 in one piece such that the stopper housing 22 is shaped generally in a cylindrical tubular form and extends from a surface of the housing plate portion 211 located on a side that is opposite to the housing tubular portion 212. The stopper housing 22 is formed coaxially with the housing tubular portion 212.

The cover housing 23 includes a cover tubular portion 231 and a cover bottom portion 232. The cover tubular portion 231 is shaped generally in a cylindrical tubular form. The cover bottom portion 232 is formed integrally with the cover tubular portion 231 in one piece such that the cover bottom portion 232 closes one end part of the cover tubular portion 231. A cover hole 230 is formed at a center of the cover bottom portion 232 such that the cover hole 230 extends through the cover bottom portion 232 in a plate thickness direction of the cover bottom portion 232. An inner peripheral surface of the cover hole 230 is shaped generally in a cylindrical form. The cover housing 23 is formed such that an end part of the cover tubular portion 231, which is opposite to the cover bottom portion 232, is joined to an end part of the stopper housing 22, which is opposite to the external toothed housing 21. The cover housing 23 is coaxial with the stopper housing 22. The cover housing 23 is joined to the stopper housing 22 and the external toothed housing 21 by bolts 15.

The external toothed portion 31 is made of, for example, metal. The external toothed portion 31 is shaped in a ring form and is formed integrally with the external toothed housing 21 in one piece such that the external toothed portion 31 is located on a radially outer side of the housing ring portion 213. The external toothed portion 31 has a plurality of external teeth, which are arranged one after another in a circumferential direction (see FIG. 3). As described above, the chain 7, which is wound around the crankshaft 2, is wound around the external toothed portion 31. The external toothed portion 31 is configured to engage with the chain 7. In this way, when the crankshaft 2 is rotated, the drive force is transmitted from the crankshaft 2 to the housing 20 through the chain 7. Therefore, the housing 20 is rotated synchronously with the crankshaft 2.

The external toothed portion 32 is made of, for example, metal. The external toothed portion 32 is shaped in a ring form and is formed integrally with the external toothed housing 21 in one piece such that the external toothed portion 32 is located on a radially outer side of the housing ring portion 214. The external toothed portion 32 has a plurality of external teeth, which are arranged one after another in a circumferential direction. As described above, the chain 8, which is wound around the sprocket 6, is wound around the external toothed portion 32. The external toothed portion 32 is configured to engage with the chain 8. In this way, when the crankshaft 2 is rotated, the drive force is transmitted from the crankshaft 2 to the sprocket 6 through the chain 7, the external toothed portion 31, the external toothed portion 32 and the chain 8. Therefore, the sprocket 6 and the camshaft 5 are rotated synchronously with the crankshaft 2.

The external toothed portion 31 and the external toothed portion 32 are coaxial with each other. A dedendum circle diameter and an addendum circle diameter of the external toothed portion 31 are set to be larger than a dedendum circle diameter and an addendum circle diameter, respectively, of the external toothed portion 32. The external toothed portion 31 and the external toothed portion 32 are arranged one after another in the axial direction of the housing 20 while a predetermined gap is interposed between the external toothed portion 31 and the external toothed portion 32. Specifically, in the present embodiment, there are two external toothed portions (31, 32) arranged one after another in the axial direction of the housing 20. The external toothed portion 31 and the external toothed portion 32 are processed through a quenching process to increase the hardness.

An external toothed portion is formed along an outer periphery of the sprocket 6 that is fixed to the camshaft 5. The number of external teeth of the external toothed portion of the sprocket 6 is equal to the number of the external teeth of the external toothed portion 32. Furthermore, a dedendum circle diameter and an addendum circle diameter of the external toothed portion of the sprocket 6 are equal to the dedendum circle diameter and the addendum circle diameter, respectively, of the external toothed portion 32.

The cam plate 40 includes a cam plate main body 41 and a bearing portion 42. The cam plate main body 41 and the bearing portion 42 are respectively made of, for example, metal. In the present embodiment, the cam plate main body 41 and the bearing portion 42 are formed integrally in one piece. The cam plate 40 is processed through a quenching process to increase the hardness.

The cam plate main body 41 is shaped in a bottomed tubular form. A plate hole 410 is formed at a center of a bottom portion of the cam plate main body 41 such that the plate hole 410 extends through the bottom portion of the cam plate main body 41 in a plate thickness direction of the bottom portion of the cam plate main body 41. The tubular portion of the cam plate main body 41 is shaped generally in a cylindrical tubular form. The bearing portion 42 is shaped generally in a cylindrical tubular form and extends from an outer periphery of the plate hole 410 at a surface of the bottom portion of the cam plate main body 41, which is opposite to the tubular portion. The tubular portion of the cam plate main body 41 and the bearing portion 42 are coaxial with each other. An inner peripheral surface and an outer peripheral surface 420 of the bearing portion 42 are respectively shaped in a form of a cylindrical surface.

The cam plate 40 is placed at an inside of the housing 20 such that the bearing portion 42 is placed at an inside of the inner peripheral surface 210 of the housing 20, and the cam plate main body 41 is placed at an inside of the stopper housing 22. Here, an outer diameter of the bearing portion 42 is set to be slightly smaller than an inner diameter of the inner peripheral surface 210.

The housing 20 has a contact surface 201. The contact surface 201 is formed at a surface of the housing plate portion 211 located on an opposite side that is opposite to the housing tubular portion 212. The contact surface 201 is configured to contact a wall surface 401 of the bottom portion of the cam plate main body 41, which is a surface of the bottom portion of the cam plate main body 41 located on the bearing portion 42 side. Specifically, the contact surface 201 is configured to contact the wall surface 401 of the cam plate 40 located on one side in the axial direction.

The cam plate 40 is coupled to the camshaft 4 such that the end part of the camshaft 4 is located at an inside of the bearing portion 42. The cam plate 40 and the camshaft 4 are fixed together by a bolt 16 such that the cam plate 40 and the camshaft 4 are not rotatable relative to each other. In this way, the cam plate 40 is rotated integrally with the camshaft 4. The cam plate 40 is rotatable relative to the housing 20.

The outer peripheral surface 420 of the bearing portion 42 receives a radial load, which is applied from the inner peripheral surface 210 of the housing 20 in the radially inner direction. Specifically, the bearing portion 42 rotatably receives the housing 20 through the outer peripheral surface 420. When the relative rotation is made between the cam plate 40 and the housing 20, the outer peripheral surface 420 of the bearing portion 42 and the inner peripheral surface 210 of the housing 20 are slid relative to each other. In the present embodiment, an axial length of the outer peripheral surface 420 of the bearing portion 42 is shorter than an axial length of the inner peripheral surface 210 of the housing 20. Therefore, in a state where the wall surface 401 of the cam plate 40 and the contact surface 201 of the housing 20 contact with each other, an end surface of the bearing portion 42, which is opposite to the cam plate main body 41, is located on the cover housing 23 side of an end surface of the housing tubular portion 212, which is opposite to the housing plate portion 211 (see FIG. 2).

A first internal toothed portion 24, which is shaped in a ring form, is formed at an inner peripheral wall of the cover tubular portion 231. The first internal toothed portion 24 has a plurality of internal teeth, which are arranged one after another in a circumferential direction. A second internal toothed portion 43, which is shaped in a ring form, is formed at an inner peripheral wall of the tubular portion of the cam plate main body 41. The second internal toothed portion 43 has a plurality of internal teeth, which are arranged one after another in a circumferential direction. The first internal toothed portion 24 and the second internal toothed portion 43 are coaxial with each other. A dedendum circle diameter and an addendum circle diameter of the first internal toothed portion 24 are set to be larger than a dedendum circle diameter and an addendum circle diameter, respectively, of the second internal toothed portion 43.

The gear 50 is made of, for example, metal and is shaped generally in a cylindrical tubular form. The gear 50 includes a first external toothed portion 51 and a second external toothed portion 52. The first external toothed portion 51 and the second external toothed portion 52 are respectively shaped in a ring form and are formed at an outer peripheral wall of the gear 50. The first external toothed portion 51 and the second external toothed portion 52 are coaxial with each other and are arranged one after another in the axial direction of the gear 50. A dedendum circle diameter and an addendum circle diameter of the first external toothed portion 51 are set to be larger than a dedendum circle diameter and an addendum circle diameter, respectively, of the second external toothed portion 52.

The gear 50 is placed at the inside of the housing 20 such that the first external toothed portion 51 is meshed with the first internal toothed portion 24, and the second external toothed portion 52 is meshed with the second internal toothed portion 43. The gear 50 is located on the cover housing 23 side of the cam plate main body 41. A dedendum circle diameter and an addendum circle diameter of the first external toothed portion 51 are set to be smaller than a dedendum circle diameter and an addendum circle diameter, respectively, of the first internal toothed portion 24. A dedendum circle diameter and an addendum circle diameter of the second external toothed portion 52 are set to be smaller than a dedendum circle diameter and an addendum circle diameter, respectively, of the second internal toothed portion 43.

Each of the stoppers 60 is made of, for example, metal. The stoppers 60 are formed integrally with the stopper housing 22 such that the stoppers 60 radially inwardly project from an inner peripheral wall of the stopper housing 22. The number of the stoppers 60 is four, and these stoppers 60 are arranged at equal intervals in a circumferential direction of the stopper housing 22 (see FIG. 3). The cam plate 40 has a plurality of stopper projections 45. The stopper projections 45 are formed integrally with the cam plate main body 41 in one piece such that the stopper projections 45 radially outwardly project from an outer peripheral wall of the tubular portion of the cam plate main body 41. The number of the stopper projections 45 is four, and these stopper projections 45 are arranged one after another at equal intervals in the circumferential direction of the cam plate main body 41 (see FIG. 3).

In the state where the cam plate 40 is placed at the inside of the housing 20, each of the four stopper projections 45 is placed between corresponding adjacent two of the stoppers 60. When the cam plate 40 is rotated relative to the housing 20, a circumferential end part of each stopper projection 45 contacts a circumferential end part of a corresponding one of the stoppers 60. Thereby, the relative rotation of the cam plate 40 relative to the housing 20 is limited. Specifically, the stoppers 60 can limit the relative rotation between the housing 20 and the cam plate 40 within a predetermined range. A predetermined gap is formed between the distal end part of each of the stopper projections 45 and the inner peripheral wall of the stopper housing 22, and also a predetermined gap is formed between the distal end part of each of the stoppers 60 and the outer peripheral wall of the tubular portion of the cam plate main body 41. Therefore, at the time of making the relative rotation between the cam plate 40 and the housing 20, although the outer peripheral surface 420 of the bearing portion 42 and the inner peripheral surface 210 of the housing 20 are slid relative to each other, each stopper projection 45 and the inner peripheral wall of the stopper housing 22 are not slid relative to each other, and each stopper 60 and the outer peripheral wall of the tubular portion of the cam plate main body 41 are not slid relative to each other.

The input member 70 is made of, for example, metal and is shaped in a tubular form. The input member 70 has a first peripheral surface 71 and a second peripheral surface 72, which extend all around the input member 70. Each of the first peripheral surface 71 and the second peripheral surface 72 is shaped generally in a form of a cylindrical surface, and the first peripheral surface 71 and the second peripheral surface 72 are formed at an outer peripheral wall of the input member 70 such that the first peripheral surface 71 and the second peripheral surface 72 are arranged one after another in the axial direction of the input member 70. Here, the first peripheral surface 71 is coaxial with the inner peripheral surface of the input member 70. The second peripheral surface 72 is formed to be eccentric by a predetermined amount relative to the inner peripheral surface of the input member 70 and the first peripheral surface 71.

The input member 70 is placed at the inside of the housing 20 such that the first peripheral surface 71 is placed at an inside of the cover hole 230 of the cover housing 23, and the second peripheral surface 72 is placed at an inside of the gear 50. A first bearing 75 is placed between the first peripheral surface 71 and the cover hole 230. A second bearing 76 is placed between the second peripheral surface 72 and the inner peripheral wall of the gear 50. With this construction, when the input member 70 is rotated relative to the housing 20, the gear 50 is rotated and is revolved relative to the housing 20 while the first external toothed portion 51 and the second external toothed portion 52 of the gear 50 are meshed with the first internal toothed portion 24 and the second internal toothed portion 43, respectively. When the gear 50 is rotated and is revolved relative to the housing 20, the relative rotation is made between the housing 20 and the cam plate 40.

The electric motor 80 includes a motor shaft 81 and a joint 82. The motor shaft 81 is fixed to a rotor (not shown) and is rotated together with the rotor when the electric power is supplied to the electric motor 80. The joint 82 is fixed to a distal end part of the motor shaft 81 and is rotatable along with the motor shaft 81. In the state where the valve timing adjustment device 1 is installed to the camshaft 4, the electric motor 80 is installed to the engine 10 on a side of the valve timing adjustment device 1, which is opposite to the camshaft 4. Energization of the electric motor 80 is controlled by an electronic control unit (not shown), which will be hereinafter referred to as an ECU, and rotation of the electric motor 80 is controlled by the ECU.

A joint groove 73, which extends in the axial direction, is formed at an inner peripheral wall of the input member 70. The electric motor 80 is installed to the engine 10 such that the joint 82 is engaged with the joint groove 73. Therefore, when the electric motor 80 is rotated in response to the supply of the electric current to the electric motor 80, the input member 70 is rotated. When the input member 70 is rotated, the gear 50 is rotated and is revolved relative to the housing 20. In this way, the relative rotation is made between the housing 20 and the cam plate 40. As described above, the gear 50 can be rotated by the electric motor 80 to implement the relative rotation between the housing 20 and the cam plate 40.

As shown in FIG. 2, according to the present embodiment, among the two external toothed portions (31, 32), the external toothed portion 32 is located on the side of the contact surface 201, which is opposite to the gear 50 in the axial direction of the housing 20. Furthermore, the cam plate 40 has the bearing portion 42 that is located on the side of the contact surface 201, which is opposite to the gear 50, and the bearing portion 42 has the outer peripheral surface 420 configured to receive the radial load applied from the inner peripheral surface 210 of the housing 20 in the radially inward direction. Therefore, when the radial load is applied to the housing 20 in the radially inner direction from the chain 7 through the external toothed portion 31 and also from the chain 8 through the external toothed portion 32, the radial load can be received by the bearing portion 42 of the cam plate 40. In this way, it is possible to limit urging of the contact surface 201 against the wall surface 401 of the cam plate 40 in response to application of the bending stress against the housing 20.

Furthermore, in the present embodiment, the midpoint MP between an outermost toothed portion 31 located on one side in the axial direction of the housing 20 among the two external toothed portions (31, 32) and the another outermost toothed portion 32 located on the another side in the axial direction of the housing 20 among the two external toothed portions (31, 32) is set on the side of the contact surface 201, which is opposite to the gear 50 in the axial direction of the housing 20. Therefore, the resultant force point FP, which is the point of application of the resultant force F3 obtained by combining the force F1 applied from the chain 7 to the external toothed portion 31 and the force F2 applied from the chain 8 to the external toothed portion 32, can exist (i.e., is existable) on the side of the contact surface 201, which is opposite to the gear 50.

Furthermore, according to the present embodiment, in the axial direction of the housing 20, the midpoint MP is set within the axial extent of the opposed section of the outer peripheral surface 420 of the bearing portion 42, which is opposed to the inner peripheral surface 210. Therefore, the resultant force point FP can be set within the axial extent of the opposed section of the outer peripheral surface 420 of the bearing portion 42, which is opposed to the inner peripheral surface 210.

Furthermore, according to the present embodiment, in the axial direction of the housing 20, the midpoint MP is set at the center of the axial extent of the opposed section of the outer peripheral surface 420 of the bearing portion 42, which is opposed to the inner peripheral surface 210. Therefore, the resultant force point FP can be set at the center of the axial extent of the opposed section of the outer peripheral surface 420 of the bearing portion 42, which is opposed to the inner peripheral surface 210.

Here, it should be noted that according to the present embodiment, the resultant force point FP can be displaced in the axial direction of the housing 20 depending on the amount of the force F1 applied from the chain 7 to the external toothed portion 31 and the amount of force F2 applied from the chain 8 to the external toothed portion 32 and/or the operational state of the engine 10.

However, according to the present embodiment, with the above construction, the resultant force point FP can exist on the side of the contact surface 201, which is opposite to the gear 50 in the axial direction of the housing 20. Furthermore, in the axial direction of the housing 20, the resultant force point FP can be set within the axial extent of the opposed section of the outer peripheral surface 420 of the bearing portion 42, which is opposed to the inner peripheral surface 210. Furthermore, in the axial direction of the housing 20, the resultant force point FP can be set at the center of the axial extent of the opposed section of the outer peripheral surface 420 of the bearing portion 42, which is opposed to the inner peripheral surface 210.

Figure 3:
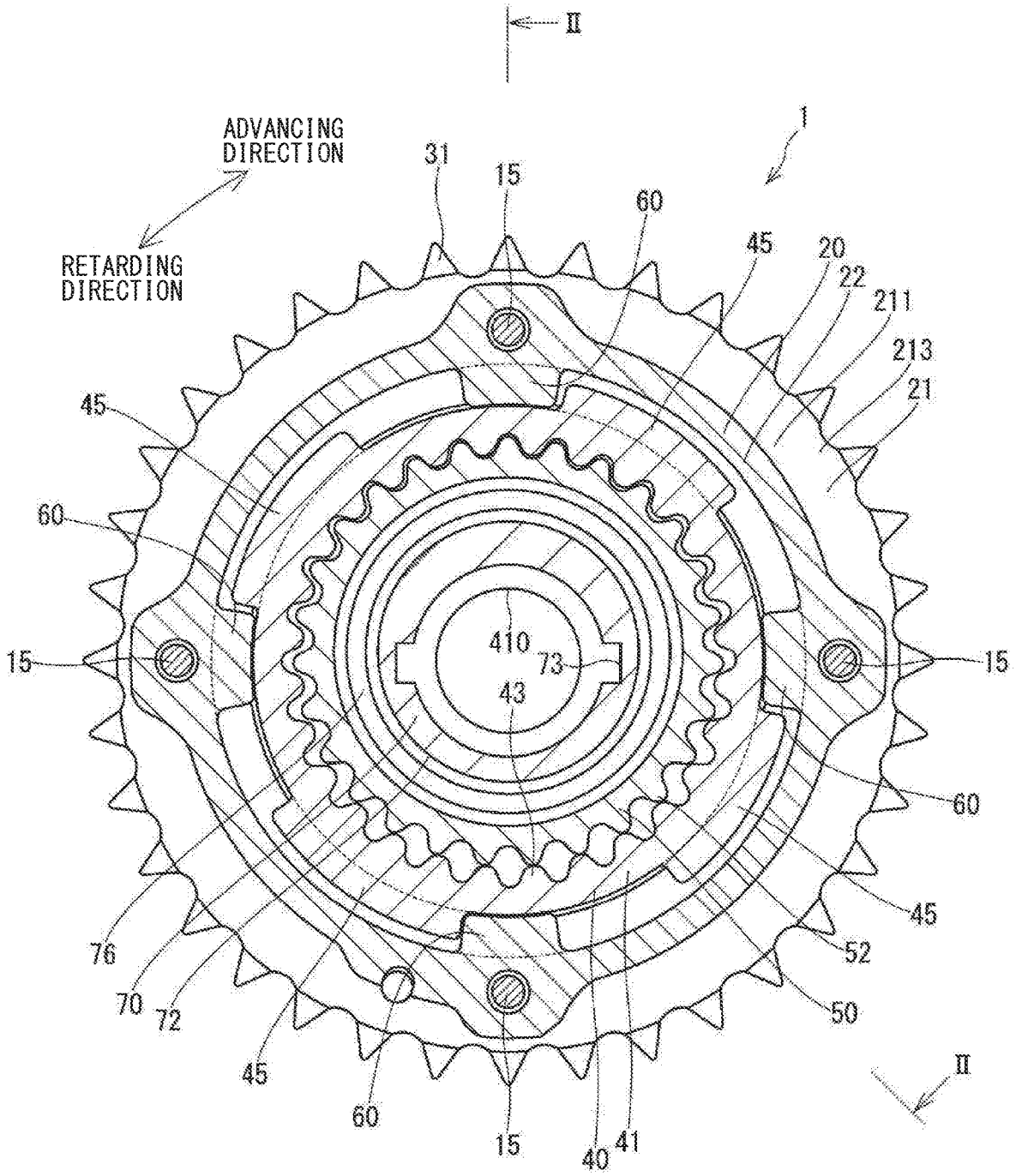
FIG. 3 is a cross-sectional view taken along line III-III in FIG. 2.

Next, the operation of the valve timing adjustment device 1 according to the present embodiment will be described. FIGS. 1 to 3 show a state of the valve timing adjustment device 1 before the time of starting the engine 10, i.e., the state of the valve timing adjustment device 1 during the stop time of the engine 10. Now, there will be described the case where the cam plate 40 is set at the most retarded position relative to the housing 20 during the stop time of the engine 10.

<Engine Start Time>

In the state where the engine 10 is stopped, the cam plate 40 is in the most retarded position relative to the housing 20. At this time, the stoppers 60, which are formed at the housing 20, respectively contact the stopper projections 45, which are formed at the cam plate 40. When the engine 10 is started, the ECU drives and rotates the electric motor 80 to rotate the input member 70 in a direction (the retarding direction) to maintain the contact between each stopper 60 and the corresponding stopper projection 45.

<After Engine Start>

At the time immediately after the start of the engine 10, the housing 20 and the cam plate 40 are rotated at the same phase. Therefore, the motor shaft 81 of the electric motor 80, the housing 20 and the cam plate 40 are rotated at the same phase and the same rotational speed.

<Advance Operation Time>

At the time of executing the advance control operation of the valve timing adjustment device 1, the ECU controls the rotation of the electric motor 80 such that the rotational speed of the input member 70 becomes higher than the rotational speed of the housing 20. In this way, the gear 50 is rotated and is revolved at the inside of the housing 20, and thereby the cam plate 40 is rotated relative to the housing 20 in the advancing direction. Therefore, the rotational phase of the camshaft 4 is advanced, and the opening/closing timing of the intake valves 11 is changed to the advance side.

<Retard Operation Time>

At the time of executing the retard control operation of the valve timing adjustment device 1, the ECU controls the rotation of the electric motor 80 such that the rotational speed of the input member 70 becomes lower than the rotational speed of the housing 20. In this way, the gear 50 is rotated and is revolved at the inside of the housing 20, and thereby the cam plate 40 is rotated relative to the housing 20 in the retarding direction. Therefore, the rotational phase of the camshaft 4 is retarded, and the opening/closing timing of the intake valves 11 is changed to the retard side.

<Intermediate Phase Maintaining Operation Time>

When the cam plate 40 (the camshaft 4) reaches the target phase, the ECU controls the rotation of the electric motor 80 such that the rotational speed of the housing 20 and the rotational speed of the input member 70 coincide with each other. In this way, the gear 50 does not rotate relative to the housing 20, and thereby the cam plate 40 maintains the predetermined phase (target phase) relative to the housing 20. Therefore, the rotational phase of the camshaft 4 is maintained at the predetermined phase (the target phase), and the opening/closing timing of the intake valves 11 is maintained at the predetermined timing.

<Engine Stop Time Operation>

When the stop of the engine 10 is commanded during the time of operating the valve timing adjustment device 1, the cam plate 40 is rotated relative to the housing 20 in the retarding direction and is stopped at the most retarded position by the operation that is similar to operation at the retard operation time.

As discussed above, according to the present embodiment, among the two external toothed portions (31, 32), the external toothed portion 32 is located on the side of the contact surface 201, which is opposite to the gear 50 in the axial direction of the housing 20. Furthermore, the cam plate 40 has the bearing portion 42 that is located on the side of the contact surface 201, which is opposite to the gear 50, and the bearing portion 42 has the outer peripheral surface 420 configured to receive the radial load applied from the inner peripheral surface 210 of the housing 20 in the radially inward direction. Therefore, in the operating period of the engine 10 and the operating period of the valve timing adjustment device 1, when the radial load is applied to the housing 20 in the radially inner direction from the chain 7 through the external toothed portion 31 and also from the chain 8 through the external toothed portion 32, the radial load can be received by the bearing portion 42 of the cam plate 40. In this way, it is possible to limit the urging of the contact surface 201 against the wall surface 401 of the cam plate 40 in response to the application of the bending stress against the housing 20.

As described above, according to the present embodiment, there is provided the valve timing adjustment device 1, which adjusts the valve timing of the intake valves 11 of the engine 10 and includes the housing 20, the external toothed portion 31, the external toothed portion 32, the cam plate 40 and the gear 50. The housing 20 can be rotated synchronously with the crankshaft 2 of the engine 10. The external toothed portion 31 and the external toothed portion 32 are respectively shaped in the annular form and are formed integrally with the housing 20 in one piece such that the external toothed portion 31 and the external toothed portion 32 are respectively configured to engaged with the chain 7 or the chain 8 wound around the crankshaft 2 or the sprocket (serving as another rotatable member that is configured to rotate) 6. In the present embodiment, the number of the external toothed portions is two (31, 32).

The cam plate 40 is coupled to the camshaft 4 of the engine 10 and is rotatable relative to the housing 20. The gear 50 is placed on the side of the cam plate 40, which is opposite to the camshaft 4, such that the gear 50 is meshed with the housing 20 and the cam plate 40, and the gear 50 is rotated by the electric motor 80 to implement the relative rotation between the housing 20 and the cam plate 40. The housing 20 has the contact surface 201 that is formed at the inner wall of the housing 20 and is configured to contact the wall surface 401 of the cam plate 40, which is located on the one side in the axial direction.

Among the two external toothed portions (31, 32), the external toothed portion 32 is located on the side of the contact surface 201, which is opposite to the gear 50 in the axial direction of the housing 20. Furthermore, the cam plate 40 has the bearing portion 42 that is located on the side of the contact surface 201, which is opposite to the gear 50, and the bearing portion 42 has the outer peripheral surface 420 configured to receive the radial load applied from the inner peripheral surface 210 of the housing 20 in the radially inward direction. Therefore, when the radial load is applied to the housing 20 in the radially inner direction from the chain 7 through the external toothed portion 31 and also from the chain 8 through the external toothed portion 32, the radial load can be received by the bearing portion 42 of the cam plate 40. In this way, it is possible to limit the urging of the contact surface 201 against the wall surface 401 of the cam plate 40 in response to the application of the bending stress against the housing 20. As a result, the deformation of the cam plate 40 can be limited, and the uneven contact between the cam plate 40 and the gear 50 can be limited. Therefore, the wearing of the gear-tooth surfaces of the meshing portions (the second internal toothed portion 43 and the second external toothed portion 52), at which the cam plate 40 and the gear 50 are meshed with each other, can be limited.

Furthermore, in the present embodiment, it is possible to limit the urging of the contact surface 201 against the wall surface 401 of the cam plate 40, and thereby it is possible to limit the generation of the excess stress at the contact surface 201 and the wall surface 401. Therefore it is possible to limit the wearing of the contact surface 201 of the housing 20 and the wall surface 401 of the cam plate 40.

In the previously proposed valve timing adjustment device discussed above, the radial load applied from the inner peripheral surface of the housing in the radially inner direction is received at the two locations, i.e., the outer peripheral surface of the cam plate and the outer peripheral surface of the driven-side shaft. Therefore, for example, in the case where the cam plate and the driven-side shaft are coupled with each other while the axis of the cam plate and the axis of the driven-side shaft are deviated from each other, a size of the gap between the outer peripheral surface of the cam plate and the inner peripheral surface of the housing and a size of the gap between the outer peripheral surface of the driven-side shaft and the inner peripheral surface of the housing vary in the circumferential direction. Thereby, the smooth relative rotation between the housing and the cam plate may possibly be interfered or disabled.

In contrast, according to the present embodiment, the predetermined gap is formed between the distal end part of each of the stopper projections 45 of the cam plate 40 and the inner peripheral wall of the stopper housing 22, and also the predetermined gap is formed between the distal end part of each of the stoppers 60 and the outer peripheral wall of the tubular portion of the cam plate main body 41. Therefore, at the time of making the relative rotation between the cam plate 40 and the housing 20, although the outer peripheral surface 420 of the bearing portion 42 and the inner peripheral surface 210 of the housing 20 are slid relative to each other, each stopper projection 45 and the inner peripheral wall of the stopper housing 22 are not slid relative to each other, and each stopper 60 and the outer peripheral wall of the tubular portion of the cam plate main body 41 are not slid relative to each other. Specifically, in the present embodiment, the radial load applied from the inner peripheral surface of the housing 20 in the radially inner direction is received at the single location of the cam plate 40. Therefore, even in the case where the cam plate 40 and the camshaft 4 are coupled with each other while the axis of the cam plate 40 and the axis of the camshaft 4 are deviated from each other, it is possible to limit the sliding between each stopper projection 45 and the inner peripheral wall of the stopper housing 22 and the sliding between each stopper 60 and the outer peripheral wall of the tubular portion of the cam plate main body 41. Thereby, it is possible to limit the disabling of the relative rotation between the housing 20 and the cam plate 40, and thereby the smooth relative rotation between the housing 20 and the cam plate 40 can be maintained.

Furthermore, in the present embodiment, the midpoint MP between the outermost toothed portion 31 located on the one side in the axial direction of the housing 20 among the two external toothed portions (31, 32) and the another outermost toothed portion 32 located on the another side in the axial direction of the housing 20 among the two external toothed portions (31, 32) is set on the side of the contact surface 201, which is opposite to the gear 50 in the axial direction of the housing 20. Therefore, the resultant force point FP, which is the point of application of the resultant force F3 obtained by combining the force F1 applied from the chain 7 to the external toothed portion 31 and the force F2 applied from the chain 8 to the external toothed portion 32, can exist on the side of the contact surface 201, which is opposite to the gear 50. In this way, it is possible to effectively limit the urging of the contact surface 201 against the wall surface 401 of the cam plate 40.

Furthermore, according to the present embodiment, in the axial direction of the housing 20, the midpoint MP is set within the axial extent of the opposed section of the outer peripheral surface 420 of the bearing portion 42, which is opposed to the inner peripheral surface 210. Therefore, the resultant force point FP can be set within the axial extent of the opposed section of the outer peripheral surface 420 of the bearing portion 42, which is opposed to the inner peripheral surface 210. In this way, it is possible to further effectively limit the urging of the contact surface 201 against the wall surface 401 of the cam plate 40.

Furthermore, according to the present embodiment, in the axial direction of the housing 20, the midpoint MP is set at the center of the axial extent of the opposed section of the outer peripheral surface 420 of the bearing portion 42, which is opposed to the inner peripheral surface 210. Therefore, the resultant force point FP can be set at the center of the axial extent of the opposed section of the outer peripheral surface 420 of the bearing portion 42, which is opposed to the inner peripheral surface 210. In this way, it is possible to further effectively limit the urging of the contact surface 201 against the wall surface 401 of the cam plate 40.

With the above construction, according to the present embodiment, the resultant force point FP can exist on the side of the contact surface 201, which is opposite to the gear 50 in the axial direction of the housing 20. Furthermore, in the axial direction of the housing 20, the resultant force point FP can be set within the axial extent of the opposed section of the outer peripheral surface 420 of the bearing portion 42, which is opposed to the inner peripheral surface 210. Furthermore, in the axial direction of the housing 20, the resultant force point FP can be set at the center of the axial extent of the opposed section of the outer peripheral surface 420 of the bearing portion 42, which is opposed to the inner peripheral surface 210. Thereby, it is possible to effectively limit the urging of the contact surface 201 against the wall surface 401 of the cam plate 40.

Second Embodiment

Figure 4:
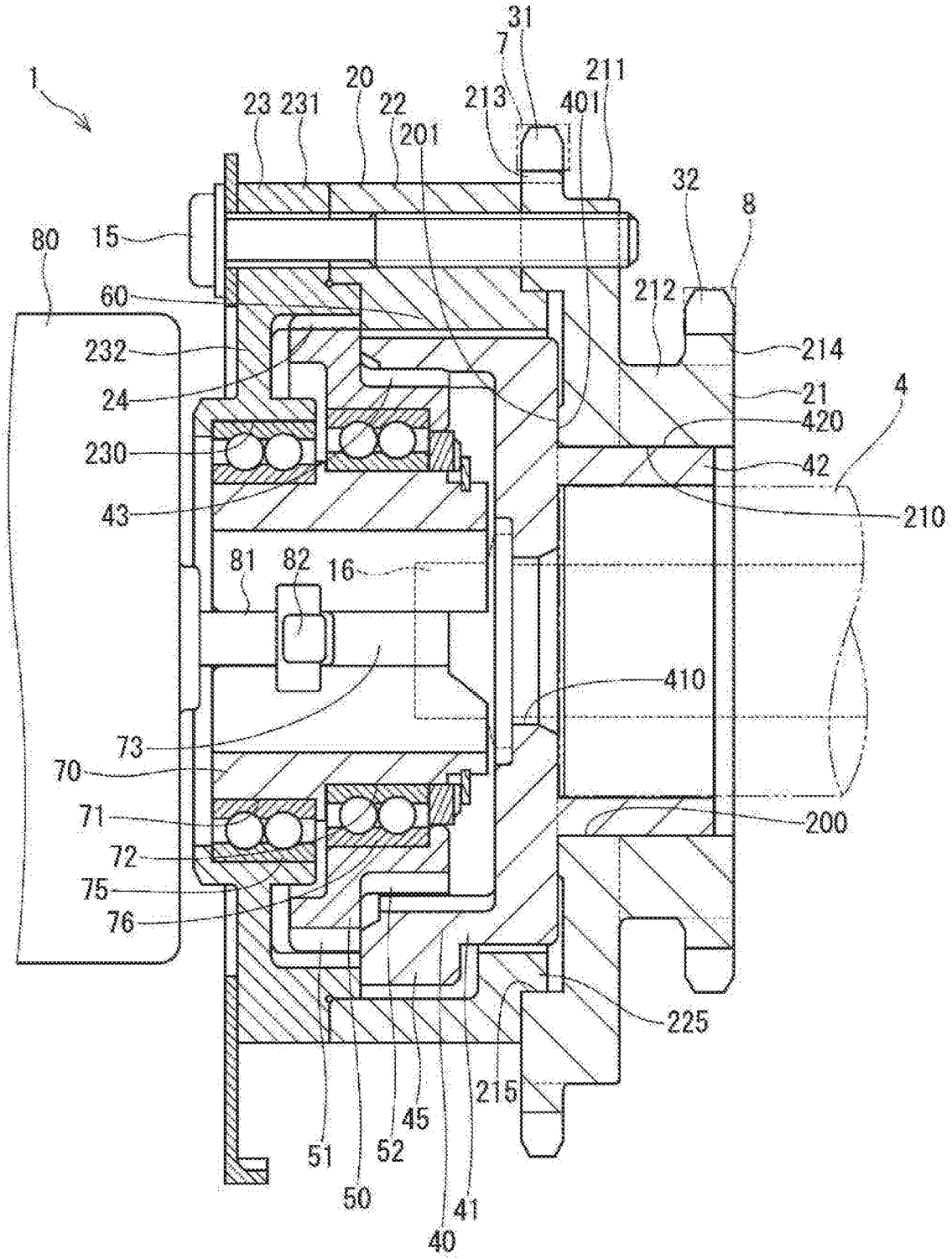
FIG. 4 is a cross-sectional view showing a valve timing adjustment device according to a second embodiment.

FIG. 4 shows a valve timing adjustment device according to a second embodiment. The second embodiment differs from the first embodiment with respect to the structure of the housing 20.

In the present embodiment, the stopper housing 22 is formed separately from the external toothed housing 21. The hardness of the stopper housing 22 is set to be higher than the hardness of the external toothed housing 21. The stopper housing 22 has a housing projection 225, which is shaped generally in a cylindrical tubular form and projects from an inner peripheral edge of an end surface of the stopper housing 22, which is located on one side. The external toothed housing 21 has a housing recess 215 that is shaped generally in a circular form and is recessed from an end surface of the housing plate portion 211, which is opposite to the housing tubular portion 212. The stopper housing 22 is joined to the external toothed housing 21 such that the housing projection 225 is fitted into the housing recess 215. The external toothed housing 21, the stopper housing 22 and the cover housing 23 are joined together by a plurality of bolts 15.

The second embodiment is similar to the first embodiment except the above described points. Therefore, the structures, which are similar to those of the first embodiment, can achieve the advantages that are similar to those of the first embodiment. In the present embodiment, since the stopper housing 22 is formed separately from the external toothed housing 21, the axis of the stopper housing 22 and the axis of the external toothed housing 21 may possibly be deviated from each other. However, in the present embodiment, the predetermined gap is set between the distal end part of each stopper projection 45 of the cam plate 40 and the inner peripheral wall of the stopper housing 22, and the predetermined gap is set between the distal end part of each stopper 60 and the outer peripheral wall of the tubular portion of the cam plate main body 41. Therefore, even when the axis of the stopper housing 22 and the axis of the external toothed housing 21 are deviated from each other, it is possible to maintain the smooth relative rotation between the housing 20 and the cam plate 40.

As described above, in the present embodiment, the stopper housing 22 and the external toothed housing 21 are formed separately from each other, so that the stopper 60 and the like can be relatively easily formed in comparison to the case where the stopper housing 22 and the external toothed housing 21 are formed integrally in one piece. Furthermore, the hardness of the stopper housing 22, at which the stoppers 60 are formed, is set to be higher than the hardness of the external toothed housing 21. Therefore, the external toothed housing 21 can be easily formed while increasing the hardness of the stopper 60.

Third Embodiment

Figure 5:
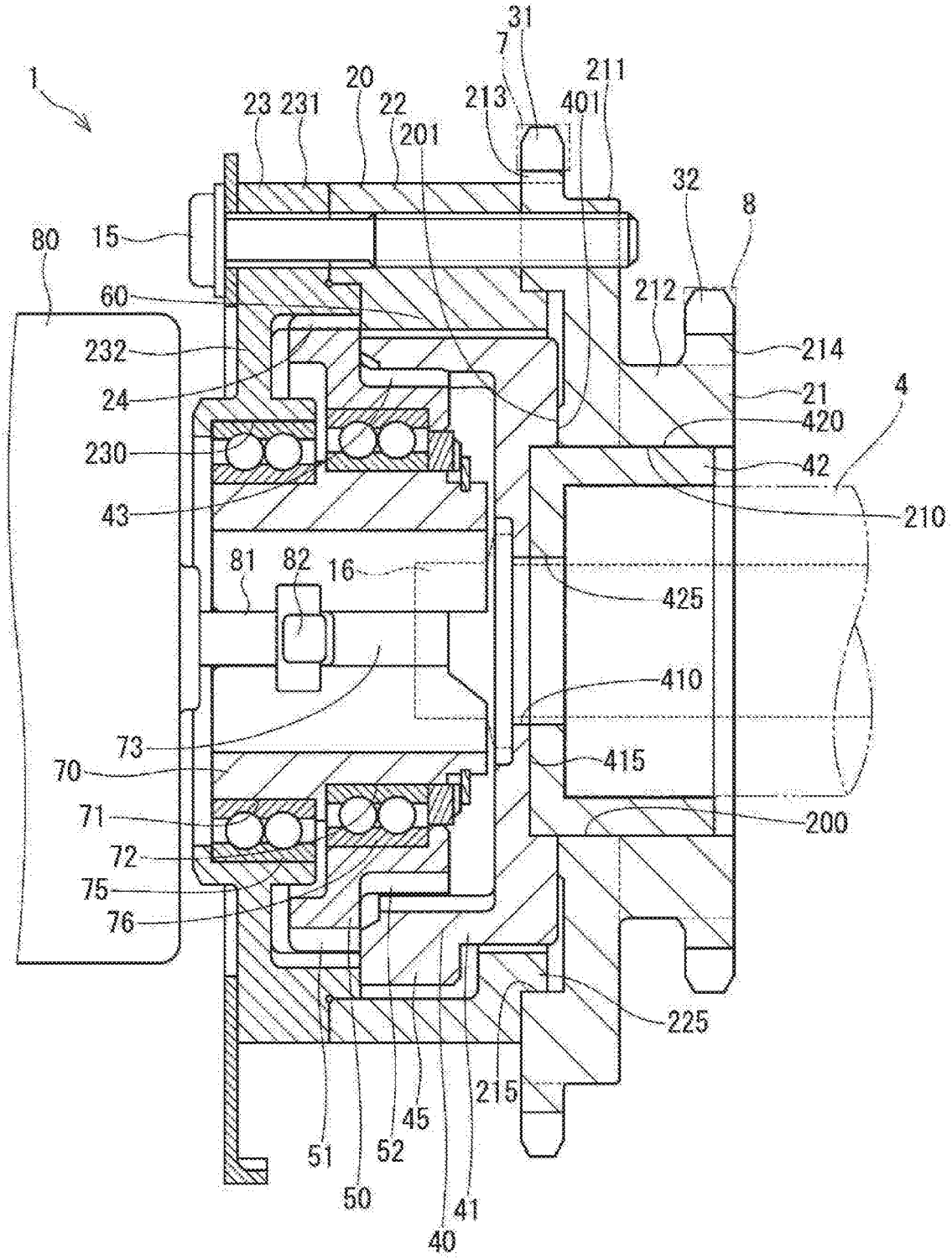
FIG. 5 is a cross-sectional view showing a valve timing adjustment device according to a third embodiment.

FIG. 5 shows a valve timing adjustment device according to a third embodiment. The third embodiment differs from the second embodiment with respect to the structure of the cam plate 40.

In the present embodiment, the bearing portion 42 is formed separately from the cam plate main body 41. The bearing portion 42 is shaped in a bottomed cylindrical tubular form. The cam plate main body 41 has a cam plate recess 415 that is shaped generally in a circular form and is recessed from an end surface of the bottom part of the cam plate main body 41, which is opposite to the tubular portion of the cam plate main body 41. The bearing portion 42 is joined to the cam plate main body 41 such that an end part of the bearing portion 42, which is located at the bottom part of the bearing portion 42, is fitted into the cam plate recess 415. A bearing hole 425 is formed at the bottom part of the bearing portion 42. The bearing hole 425 is communicated with the plate hole 410. The cam plate main body 41, the bearing portion 42 and the camshaft 4 are fixed together by the bolt 16.

The third embodiment is similar to the second embodiment except the above described points. Therefore, the structures, which are similar to those of the second embodiment, can achieve the advantages that are similar to those of the second embodiment.

As described above, in the present embodiment, the bearing portion 42 and the cam plate main body 41 are formed separately from each other. Therefore, in the case where the offset amount of the external toothed housing 21, which is offset toward the camshaft 4, is large, the cam plate 40 can be easily formed, and the costs can be reduced.

Fourth Embodiment

Figure 6:
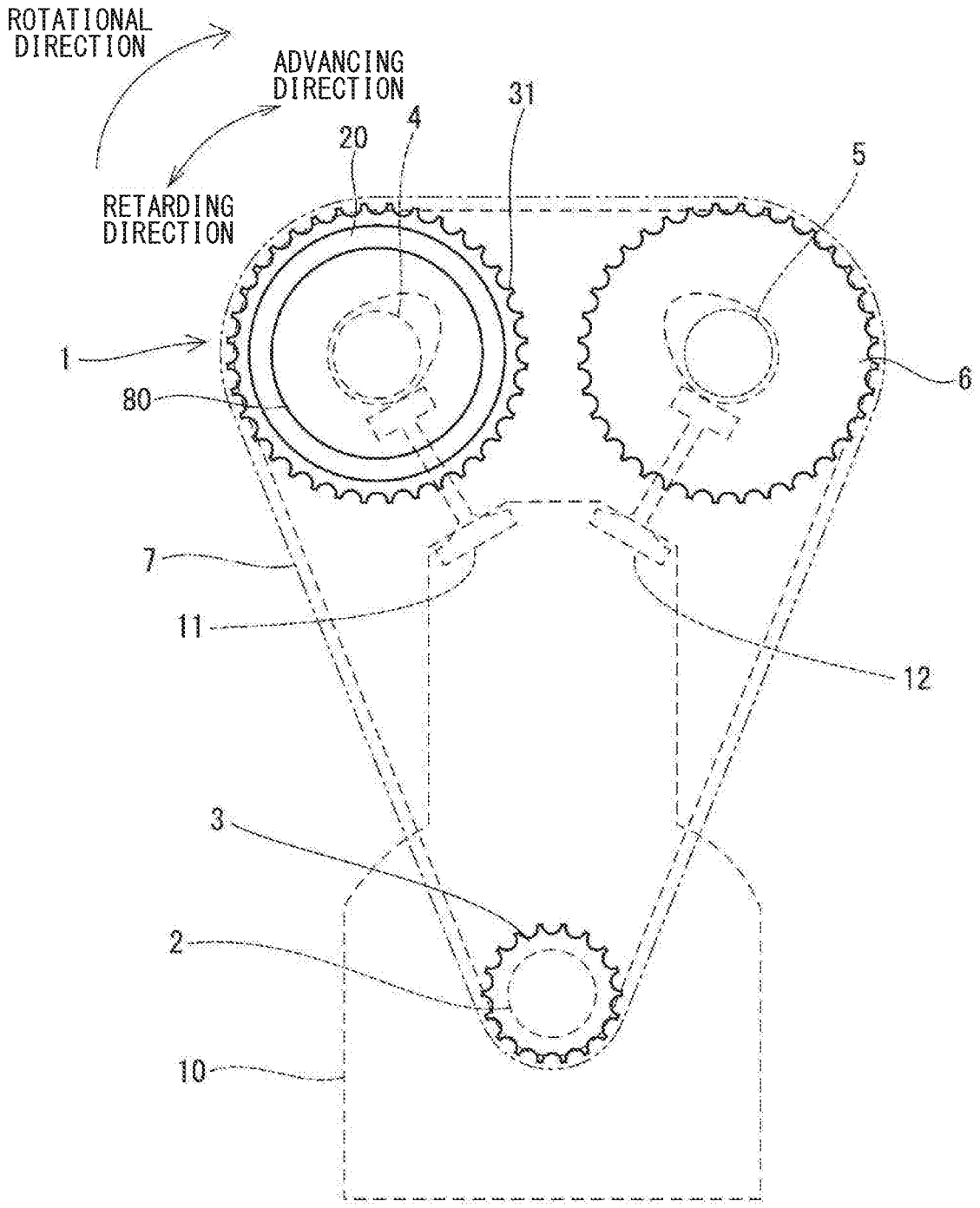
FIG. 6 is a schematic diagram showing an installed state of a valve timing adjustment device according to a fourth embodiment.
Figure 7:
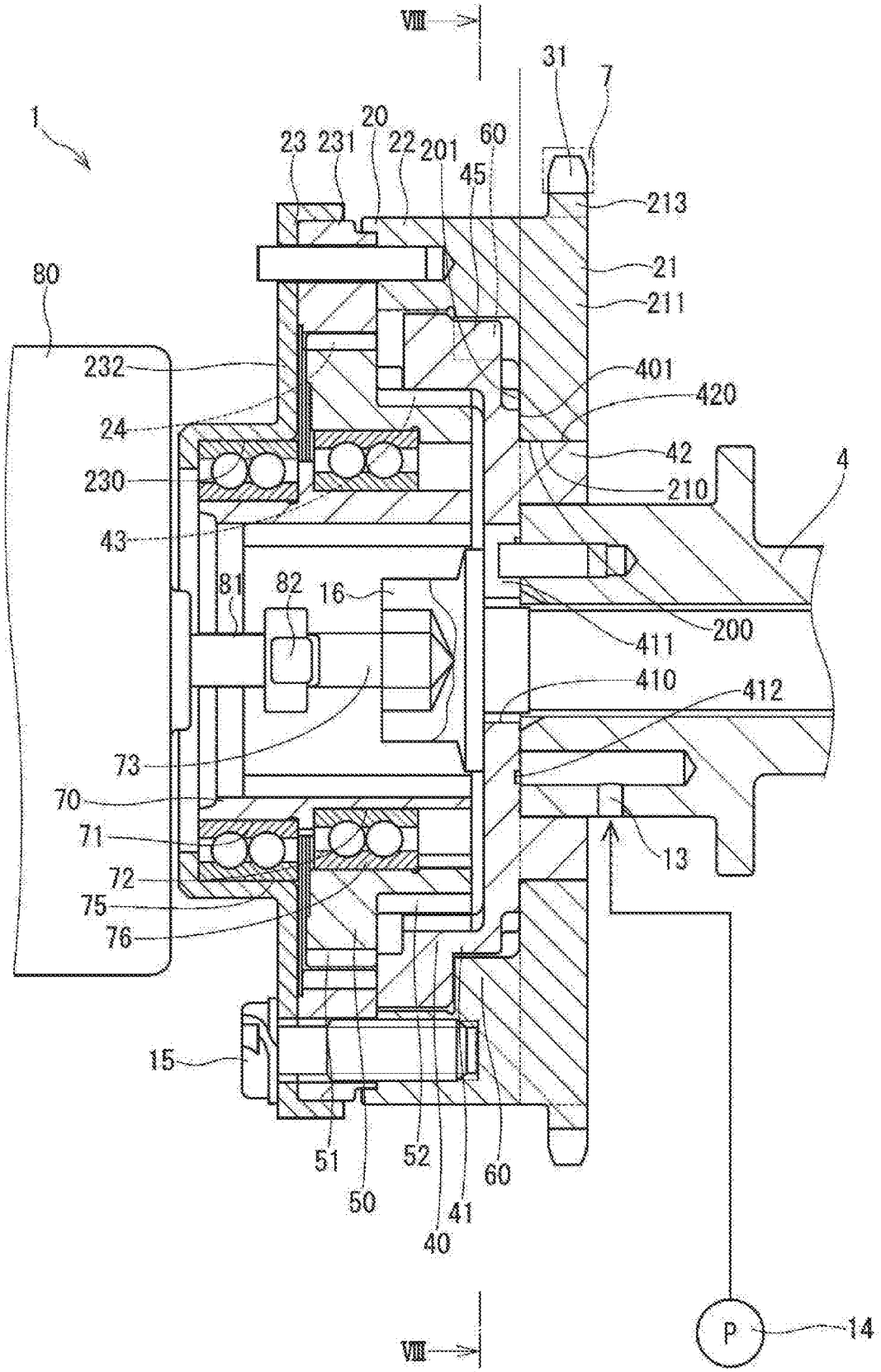
FIG. 7 is a cross-sectional view showing the valve timing adjustment device according to the fourth embodiment.
Figure 8:
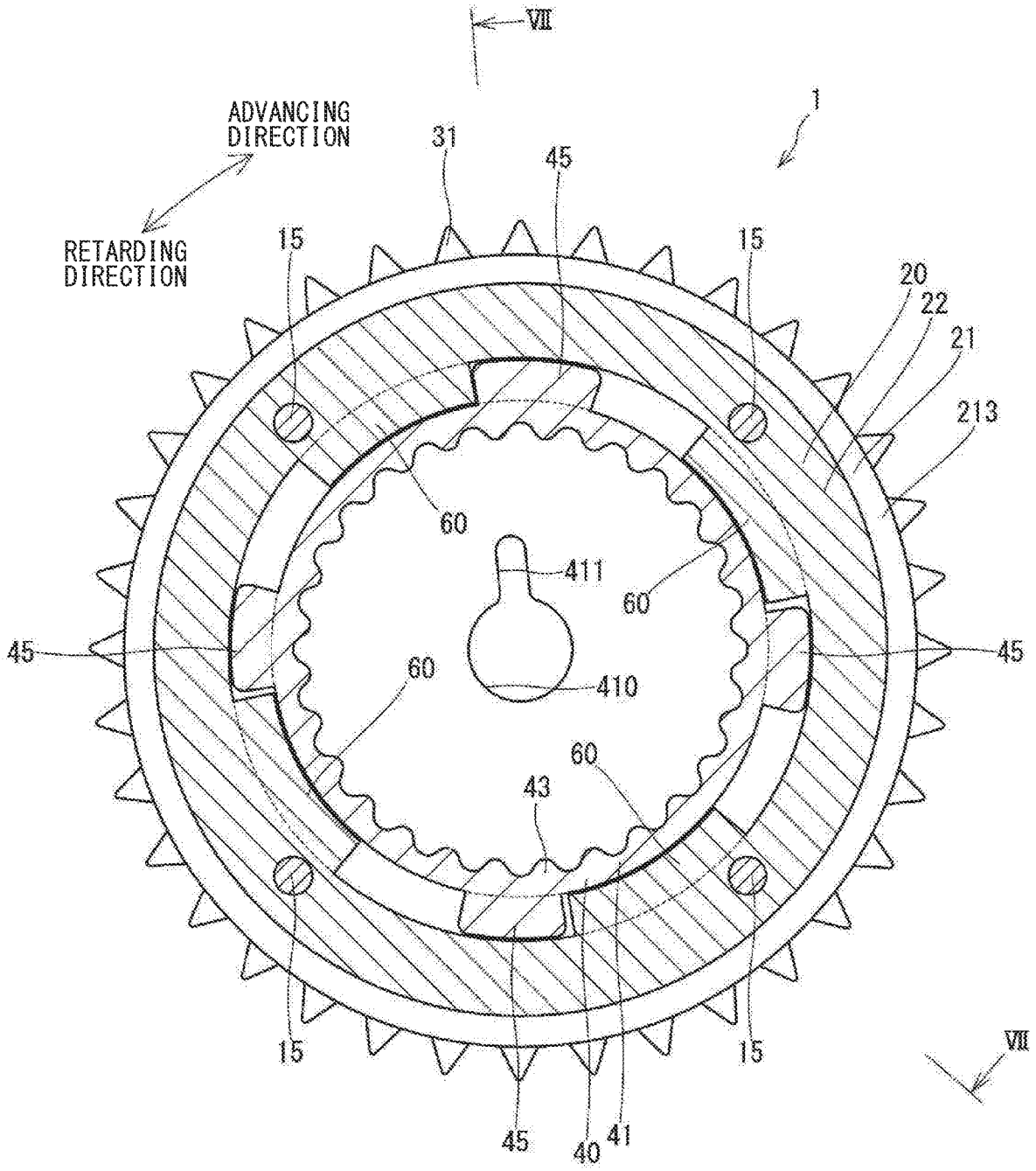
FIG. 8 is a cross-sectional view taken along line VIII-VIII in FIG. 7.

FIGS. 6 to 8 show a valve timing adjustment device according to a fourth embodiment. The fourth embodiment differs from the first embodiment with respect to the structure of the housing 20.

As shown in FIG. 7, in the present embodiment, the external toothed housing 21 includes the housing plate portion 211 and the housing ring portion 213 but does not include the housing tubular portion 212 and the housing ring portion 214 indicated in the first embodiment. Furthermore, in the present embodiment, the external toothed portion 32 indicated in the first embodiment is not provided.

The housing ring portion 213 is shaped in a ring form and is formed integrally with the housing plate portion 211 in one piece such that the housing ring portion 213 radially outwardly extends from the outer peripheral surface of the end part of the housing plate portion 211, which is opposite to the stopper housing 22. The external toothed portion 31 is shaped in a ring form and is formed integrally with the external toothed housing 21 in one piece such that the external toothed portion 31 is located on a radially outer side of the housing ring portion 213. The cover tubular portion 231 and the cover bottom portion 232 are formed separately from each other.

In the present embodiment, the cam plate main body 41 has an extended hole 411. The extended hole 411 extends from the plate hole 410 in the radially outward direction (see FIGS. 7 and 8). The bottom part of the cam plate main body 41 has an annular groove 412, which is shaped in an annular form and is formed on the radially outer side of the plate hole 410 such that the annular groove 412 is recessed from an end surface of the bottom part of the cam plate main body 41 located on the bearing portion 42 side. The annular groove 412 is connected to the extended hole 411.

In the present embodiment, an oil passage 13 is formed at the end part of the camshaft 4. When the valve timing adjustment device 1 is installed to the camshaft 4, the oil passage 13 is connected to the annular groove 412. A pump 14 is connected to the oil passage 13. The pump 14 suctions lubricant oil stored in an oil pan (not shown) and supplies the suctioned lubricant oil to the valve timing adjustment device 1. The lubricant oil, which is outputted from the pump 14, flows into the inside of the cam plate main body 41 through the oil passage 13, the annular groove 412 and the extended hole 411. The lubricant oil, which flows into the inside of the cam plate main body 41, flows between the second external toothed portion 52 and the second internal toothed portion 43 and also between the first external toothed portion 51 and the first internal toothed portion 24 to lubricate these portions. In this way, wearing between the second external toothed portion 52 and the second internal toothed portion 43 and wearing between the first external toothed portion 51 and the first internal toothed portion 24 are limited.

As shown in FIG. 8, like in the first embodiment, the number of the stoppers 60 is four, and these stoppers 60 are arranged one after another at equal intervals in the circumferential direction of the stopper housing 22. Furthermore, similar to the first embodiment, the number of the stopper projections 45 is four, and these stopper projections 45 are arranged one after another at equal intervals in the circumferential direction of the cam plate main body 41.

As shown in FIG. 6, the engine 10, at which the valve timing adjustment device 1 of the present embodiment is applied, has the chain 7 but does not include the chain 8 indicated in the first embodiment. The chain 7 is wound around the sprocket 3, the external toothed portion 31 and the sprocket 6. Here, the number of the external teeth of the external toothed portion of the sprocket 6 is the same as the number of the external teeth of the external toothed portion 31. Furthermore, a dedendum circle diameter and an addendum circle diameter of the external toothed portion of the sprocket 6 are equal to the dedendum circle diameter and the addendum circle diameter, respectively, of the external toothed portion 31.

As shown in FIG. 7, in the present embodiment, an axial length of the outer peripheral surface 420 of the bearing portion 42 is substantially the same as an axial length of the inner peripheral surface 210 of the housing 20. Therefore, in a state where the wall surface 401 of the cam plate 40 and the contact surface 201 of the housing 20 contact with each other, the end surface of the bearing portion 42, which is opposite to the cam plate main body 41, is located along a plane that is substantially the same as a plane of the end surface of the housing plate portion 211, which is opposite to the stopper housing 22.

According to the present embodiment, the external toothed portion 31 is located on the side of the contact surface 201, which is opposite to the gear 50 in the axial direction of the housing 20. Furthermore, the cam plate 40 has the bearing portion 42 that is located on the side of the contact surface 201, which is opposite to the gear 50, and the bearing portion 42 has the outer peripheral surface 420 configured to receive the radial load applied from the inner peripheral surface 210 of the housing 20 in the radially inward direction. Therefore, when the radial load is applied to the housing 20 in the radially inner direction from the chain 7 through the external toothed portion 31, the radial load can be received by the bearing portion 42 of the cam plate 40. In this way, it is possible to limit urging of the contact surface 201 against the wall surface 401 of the cam plate 40 in response to the application of the bending stress against the housing 20.

Furthermore, according to the present embodiment, in the axial direction of the housing 20, the external toothed portion 31 is located within the axial extent of the opposed section of the outer peripheral surface 420 of the bearing portion 42, which is opposed to the inner peripheral surface 210. Therefore, when the radial load is applied to the housing 20 in the radially inner direction from the chain 7 through the external toothed portion 31, the radial load can be appropriately received by the bearing portion 42 of the cam plate 40.

As described above, according to the present embodiment, there is provided the single external toothed portion (31). The external toothed portion 31 is located on the side of the contact surface 201, which is opposite to the gear 50 in the axial direction of the housing 20. Furthermore, the cam plate 40 has the bearing portion 42 that is located on the side of the contact surface 201, which is opposite to the gear 50, and the bearing portion 42 has the outer peripheral surface 420 configured to receive the radial load applied from the inner peripheral surface 210 of the housing 20 in the radially inward direction. Therefore, when the radial load is applied to the housing 20 in the radially inner direction from the chain 7 through the external toothed portion 31, the radial load can be received by the bearing portion 42 of the cam plate 40. In this way, it is possible to limit urging of the contact surface 201 against the wall surface 401 of the cam plate 40 in response to the application of the bending stress against the housing 20. As a result, the deformation of the cam plate 40 can be limited, and the uneven contact between the cam plate 40 and the gear 50 can be limited. Therefore, like the first embodiment, the wearing of the gear-tooth surfaces of the meshing portions (the second internal toothed portion 43 and the second external toothed portion 52), at which the cam plate 40 and the gear 50 are meshed with each other, can be limited.

Furthermore, according to the present embodiment, in the axial direction of the housing 20, the external toothed portion 31 is located within the axial extent of the opposed section of the outer peripheral surface 420 of the bearing portion 42, which is opposed to the inner peripheral surface 210. Therefore, when the radial load is applied to the housing 20 in the radially inner direction from the chain 7 through the external toothed portion 31, the radial load can be appropriately received by the bearing portion 42 of the cam plate 40. In this way, it is possible to effectively limit the urging of the contact surface 201 against the wall surface 401 of the cam plate 40.

Fifth Embodiment

Figure 9:
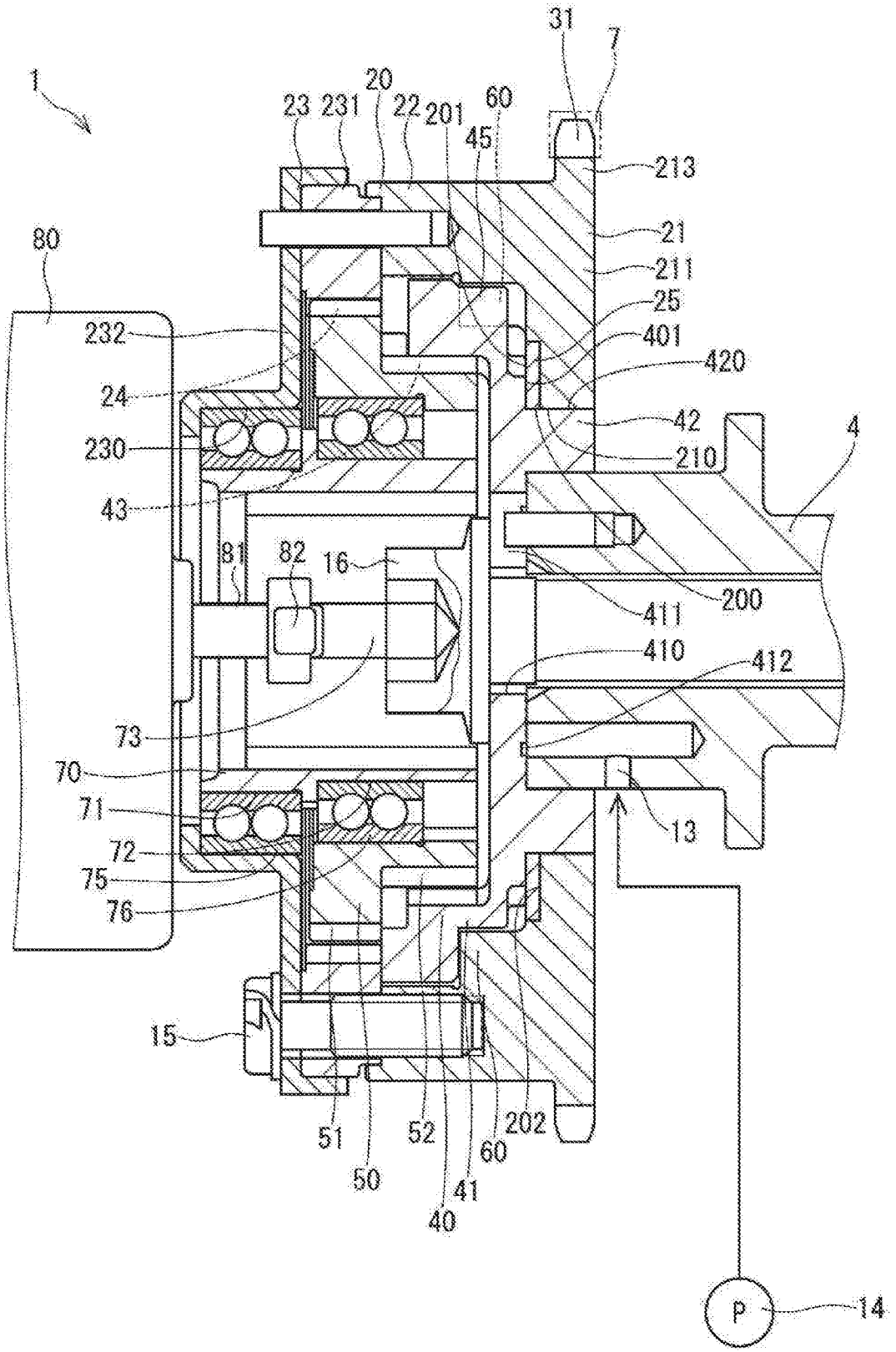
FIG. 9 is a cross-sectional view showing a valve timing adjustment device according to a fifth embodiment.

FIG. 9 shows a valve timing adjustment device according to a fifth embodiment. The fifth embodiment differs from the fourth embodiment with respect to the structure of the housing 20.

In the present embodiment, the housing 20 include a plate 25. The plate 25 is shaped generally in a circular ring plate form and is made of, for example, metal. The hardness of the plate 25 is set to be higher than the hardness of the housing plate portion 211. The housing plate portion 211 has an annular recess 202, which is located on the radially outer side of the housing hole 200 and is recessed in an annular form from an end surface of the housing plate portion 211 located on the stopper housing 22 side. An inner diameter and an outer diameter of the annular recess 202 are generally the same as an inner diameter and an outer diameter of the plate 25. Furthermore, a depth of the annular recess 202 is generally the same as a plate thickness of the plate 25. The plate 25 is installed to the housing plate portion 211 such that the plate 25 is fitted to the annular recess 202. In the present embodiment, the contact surface 201, which can contact the wall surface 401 of the cam plate 40, is formed at the end surface of the plate 25 located on the gear 50 side. In the present embodiment, since the contact surface 201 is formed at the plate 25, it is possible to limit the wearing of the housing plate portion 211 caused by the sliding between the cam plate 40 and the housing plate portion 211.

Other Embodiments

In another embodiment of the present disclosure, as long as at least one external toothed portion is formed on the side of the contact surface 201, which is opposite to the gear 50 in the axial direction of the housing 20, the number of the external toothed portions, which are arranged in the axial direction of the housing 20, may be equal to or larger than three.

Furthermore, in another embodiment of the present disclosure, the midpoint between the outermost toothed portion located on the one side in the axial direction of the housing among the plurality of external toothed portions and the another outermost toothed portion located on the another side in the axial direction of the housing among the plurality of external toothed portions may be set on the side of the contact surface 201 where the gear 50 is placed in the axial direction of the housing 20.

Furthermore, in another embodiment of the present disclosure, in the axial direction of the housing 20, the midpoint may be set at an outside of the axial range of the opposed section of the outer peripheral surface 420 of the bearing portion 42, which is opposed to the inner peripheral surface 210 of the housing 20.

Furthermore, in another embodiment of the present disclosure, in the axial direction of the housing 20, the midpoint may be set at the center of the axial range of the opposed section of the outer peripheral surface 420 of the bearing portion 42, which is opposed to the inner peripheral surface 210 of the housing 20. Furthermore, in another embodiment of the present disclosure, in the axial direction of the housing 20, the midpoint may be set at another location, which is other than the center, at the axial range of the opposed section of the outer peripheral surface 420 of the bearing portion 42, which is opposed to the inner peripheral surface 210 of the housing 20.

Furthermore, in another embodiment of the present disclosure, in the axial direction of the housing 20, the at least one external toothed portion may be set at the center of the axial range of the opposed section of the outer peripheral surface 420 of the bearing portion 42, which is opposed to the inner peripheral surface 210 of the housing 20. More specifically, in the axial direction of the housing 20, the at least one external toothed portion may be set at the center of the axial range of the opposed section of the outer peripheral surface 420 of the bearing portion 42, which is opposed to the inner peripheral surface 210 of the housing 20. This structure is suitable for the case where the single external toothed portion is formed in the axial direction of the housing 20.

Furthermore, in another embodiment of the present disclosure, another transmission member, such as a belt, may be used in place of the chain.

Furthermore, in the above embodiments, there are described the examples where the cam plate 40 is fixed to the end part of the camshaft 4, and the housing 20 is rotated synchronously with the crankshaft 2. Alternatively, in another embodiment of the present disclosure, the cam plate 40 may be fixed to the end part of the crankshaft 2, and the housing 20 may be rotated synchronously with the camshaft 4.

The valve timing adjustment device 1 of the present disclosure may be configured to adjust a valve timing of the exhaust valves 12 of the engine 10.

As described above, the present disclosure is not necessarily limited to the above embodiments and may be implemented in various forms without departing from the scope of the present disclosure.

The present disclosure has been described based on the embodiments. However, the present disclosure is not necessarily limited to the embodiments and the structures described therein. The present disclosure also encompasses various modifications and variations within equivalent scope. In addition, various combinations and forms, and other combinations and forms including only one element, more or less, are also included in the scope and spirit of the present disclosure.

The invention claimed is:

1. A valve timing adjustment device configured to adjust a valve timing of a valve of an internal combustion engine, the valve timing adjustment device comprising:

a housing that is configured to rotate synchronously with one of a driving-side shaft and a driven-side shaft of the internal combustion engine;

at least one external toothed portion that is shaped in a ring form and is formed integrally with the housing in one piece, wherein the at least one external toothed portion is configured to engage with an endless transmission member that is wound around the driving-side shaft or another rotatable member that is configured to rotate;

a cam plate that is coupled with another one of the driving-side shaft and the driven-side shaft and is configured to rotate relative to the housing; and a gear that is located on a side of the cam plate, which is opposite to the another one of the driving-side shaft and the driven-side shaft, wherein the gear is configured to be meshed with the housing and the cam plate and is configured to be rotated by an electric motor to implement relative rotation between the housing and the cam plate, wherein:

the housing has a contact surface that is formed at an inner wall of the housing and is configured to contact a wall surface of the cam plate in an axial direction of the housing;

the at least one external toothed portion is located on one side of the contact surface, which is opposite to the gear in the axial direction of the housing;

the cam plate has a bearing portion that is located on the one side of the contact surface, wherein the bearing portion has an outer peripheral surface configured to receive a radial load applied from an inner peripheral surface of the housing in a radially inward direction;

the cam plate includes a plurality of internal teeth meshed with a plurality of external teeth of the gear;

the plurality of internal teeth of the cam plate exists only on another side of the contact surface where the gear is placed in the axial direction; and a radial gap is formed between the inner peripheral surface of the housing and an outer peripheral surface of an adjacent portion of the cam plate, which is adjacent to the contact surface and is located on the another side of the contact surface in the axial direction, to limit application of the radial load from the inner peripheral surface of the housing against the outer peripheral surface of the adjacent portion of the cam plate.

2. The valve timing adjustment device according to claim 1, wherein:

the at least one external toothed portion is one of a plurality of external toothed portions, which are arranged one after another in the axial direction of the housing; and a midpoint between a closest toothed portion placed closest to the gear in the axial direction among the plurality of external toothed portions and a farthest toothed portion placed farthest from the gear in the axial direction is set on the one side of the contact surface.

3. The valve timing adjustment device according to claim 2, wherein in the axial direction of the housing, the midpoint is set within an axial extent of an opposed section of the outer peripheral surface of the bearing portion, which is opposed to the inner peripheral surface of the housing.

4. The valve timing adjustment device according to claim 3, wherein in the axial direction of the housing, the midpoint is set at a center of the axial extent of the opposed section of the outer peripheral surface of the bearing portion, which is opposed to the inner peripheral surface of the housing.

5. The valve timing adjustment device according to claim 1, wherein:

the at least one external toothed portion is one of a plurality of external toothed portions, which are arranged one after another in the axial direction of the housing; and a resultant force point, which is a point of application of a resultant force obtained by combining a plurality of forces applied from the endless transmission member to the plurality of external toothed portions, respectively, is existable on the one side of the contact surface.

6. The valve timing adjustment device according to claim 5, wherein in the axial direction of the housing, the resultant force point is existable within an axial extent of an opposed section of the outer peripheral surface of the bearing portion, which is opposed to the inner peripheral surface of the housing.

7. The valve timing adjustment device according to claim 6, wherein in the axial direction of the housing, the resultant force point is existable at a center of the axial extent of the opposed section of the outer peripheral surface of the bearing portion, which is opposed to the inner peripheral surface of the housing.

8. The valve timing adjustment device according to claim 1, wherein in the axial direction of the housing, the at least one external toothed portion is located within an axial extent of an opposed section of the outer peripheral surface of the bearing portion, which is opposed to the inner peripheral surface of the housing.

9. The valve timing adjustment device according to claim 8, wherein in the axial direction of the housing, the at least one external toothed portion is located at a center of the axial extent of the opposed section of the outer peripheral surface of the bearing portion, which is opposed to the inner peripheral surface of the housing.

10. The valve timing adjustment device according to claim 1, wherein:

the housing includes:

an external toothed housing, at which the at least one external toothed portion is formed; and a stopper housing, which is formed separately from the external toothed housing; and the valve timing adjustment device further comprises a stopper that is formed integrally with the stopper housing in one piece and is configured to limit the relative rotation between the housing and the cam plate within a predetermined range when the stopper contacts the cam plate.

11. The valve timing adjustment device according to claim 1, wherein the cam plate includes a cam plate main body and the bearing portion while the the bearing portion is formed separately from the cam plate main body and is fitted to the cam plate main body, and the bearing portion is coupled to the another one of the driving-side shaft and the driven-side shaft.

12. The valve timing adjustment device according to claim 1, wherein:

the at least one external toothed portion is one of a plurality of external toothed portions, which are arranged one after another in the axial direction; and a part of the bearing portion, which is configured to receive the radial load applied from the inner peripheral surface of the housing, is located on a radially inner side of a farthest toothed portion, which is farthest from the gear in the axial direction among the plurality of external toothed portions.

* * * * *